US006170084B1

(12) United States Patent
Gordon et al.

(10) Patent No.: US 6,170,084 B1
(45) Date of Patent: Jan. 9, 2001

(54) CLIP-ON VISOR

(75) Inventors: Kevin Gordon, Cary, NC (US); Steve Sasaki, San Jose, CA (US)

(73) Assignee: Specialized Bicycle Components, Inc., Morgan Hill, CA (US)

( * ) Notice: Under 35 U.S.C. 154(b), the term of this patent shall be extended for 0 days.

(21) Appl. No.: 09/107,656

(22) Filed: Jun. 30, 1998

(51) Int. Cl.[7] ..... A42B 3/04
(52) U.S. Cl. ..... 2/12; 2/422
(58) Field of Search ..... 2/410, 422, 424, 2/425, 15, 10, 12, 195.1, 195.7, 171.3

(56) References Cited

U.S. PATENT DOCUMENTS

| | | | | |
|---|---|---|---|---|
| D. 327,752 | | 7/1992 | Lee | D29/16 |
| 3,239,842 | * | 3/1966 | Marchello | 2/422 |
| 4,017,906 | | 4/1977 | Bochynsky et al. | 2/10 |
| 4,076,007 | | 2/1978 | Redlin | 125/30 |
| 4,100,619 | | 7/1978 | Piech et al. | 2/10 |
| 4,150,681 | | 4/1979 | Howarth, Jr. | 134/172 |
| 4,333,180 | | 6/1982 | Bay | 2/10 |
| 4,445,253 | | 5/1984 | Howey | 24/68 |
| 4,507,809 | | 4/1985 | Stepan | 2/424 |
| 4,519,099 | | 5/1985 | Kamiya et al. | 2/424 |
| 4,538,303 | | 9/1985 | Schnitzler | 2/424 |
| 4,575,875 | | 3/1986 | Dawson et al. | 2/422 |
| 4,581,776 | | 4/1986 | Kie | 2/425 |
| 4,586,197 | | 5/1986 | Hubbard | 2/410 |
| 4,638,728 | | 1/1987 | Elenewski | 98/2.08 |
| 4,700,411 | * | 10/1987 | Kawasaki et al. | 2/425 |
| 4,744,107 | | 5/1988 | Fohl | 2/422 |
| 4,794,652 | * | 1/1989 | Planta et al. | 2/414 |
| 4,813,083 | | 3/1989 | Davidson | 2/422 |
| 4,884,302 | | 12/1989 | Foehl | 2/424 |
| 5,001,786 | | 3/1991 | Copeland | 2/424 |
| 5,005,221 | | 4/1991 | Chen | 2/424 |
| 5,006,072 | | 4/1991 | Letovsky et al. | 424/61 |
| 5,093,937 | * | 3/1992 | Kamata | 2/424 |
| 5,095,551 | | 3/1992 | Chin | 2/424 |
| 5,259,070 | | 11/1993 | De Roza | 2/413 |
| 5,333,328 | | 8/1994 | Roberts | 2/422 |
| 5,351,339 | | 10/1994 | Reuber et al. | 2/9 |
| 5,432,960 | | 7/1995 | Kraut | 2/422 |
| 5,469,584 | | 11/1995 | Casartelli | 2/422 |
| 5,481,759 | * | 1/1996 | Rinaldi | 2/425 |
| 5,500,953 | | 3/1996 | Reuber et al. | 2/9 |
| 5,508,900 | | 4/1996 | Norman | 362/106 |
| 5,517,698 | | 5/1996 | Nault et al. | 2/424 |
| 5,621,923 | | 4/1997 | Tapocik | 2/422 |
| 5,675,843 | | 10/1997 | Grim et al. | 2/422 |
| 6,009,561 | * | 1/2000 | Bullock et al. | 2/422 |
| 6,009,562 | * | 1/2000 | Bullock et al. | 2/422 |

FOREIGN PATENT DOCUMENTS

| | | |
|---|---|---|
| 0268549 | 3/1990 | (EP) . |
| 0338703 | 10/1994 | (EP) . |
| 0 761 112A1 | 8/1996 | (EP) . |

* cited by examiner

*Primary Examiner*—Michael A. Neas

(57) ABSTRACT

A visor is provided. The visor includes a brim and a coupling mechanism designed to removably couple the visor to a helmet through a vent of the helmet.

13 Claims, 14 Drawing Sheets

CLIP-ON VISOR

FIELD OF THE INVENTION

The present invention relates to visors, and more specifically, to visors designed to be coupled to a helmet.

BACKGROUND

Sports such as bicycling, in-line skating, and skateboarding require protective helmets. The helmet is a protective shell that is designed to protect the head. Generally helmets do not include visors to shield the user's eyes from the sun.

FIG. 1 is one helmet including a prior art visor. The helmet 10 includes straps 26 to fasten the helmet 10 to the user's head. The helmet also includes air vents 36 in the front and back of the helmet 10.

A visor 32 is coupled to the helmet 10. The visor is attached at both the sides and the front of the helmet 10 using a hook and loop type fastener, such as Velcro. Patches 36 of the fastener are attached to the outside of the helmet 10. Matching patches are attached to the inside of the visor 32. The visor 32 is attached to the helmet 10 using the hook and loop type fastener, and removed by grasping the visor 32 and pulling firmly.

However, the helmet and visor of FIG. 1 have numerous disadvantages. The hook and loop type fastener may not remain on the helmet in hot weather. Removing the visor requires considerable force, otherwise the visor may accidentally detach. The visor alters the aerodynamic quality of the helmet. And the visor only fits one type of helmet, since the locations of the hook and loop type fastener patches must match, and the diameter of the helmet must be precisely reflected by the visor in order to match the hook and loop type fastener patches.

SUMMARY OF THE INVENTION

A visor is described. The visor includes a brim and a coupling mechanism designed to removably couple the visor to a helmet through a vent of the helmet.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

A visor is described. The visor includes a brim, and a coupling mechanism designed to removably couple the visor to a helmet through a vent of the helmet. By using a single coupling mechanism, the attachment and removal of the helmet is simplified. Furthermore, the shape of the visor is aerodynamic, and does not create additional drag. Also, for one embodiment, the visor has multiple positions, so the rider can adjust the visor to the sun conditions.

Figure 1:
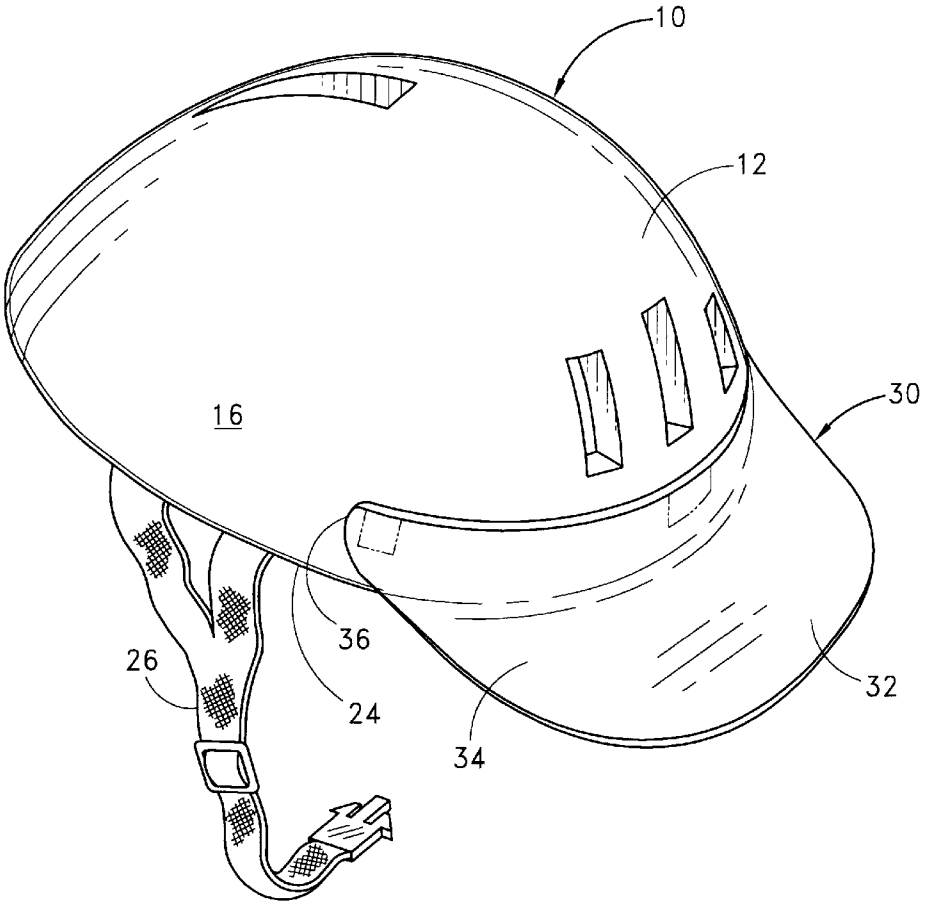
FIG. 1 (PRIOR ART)
FIG. 1 is a perspective view of a prior-art helmet and visor.
Figure 2:
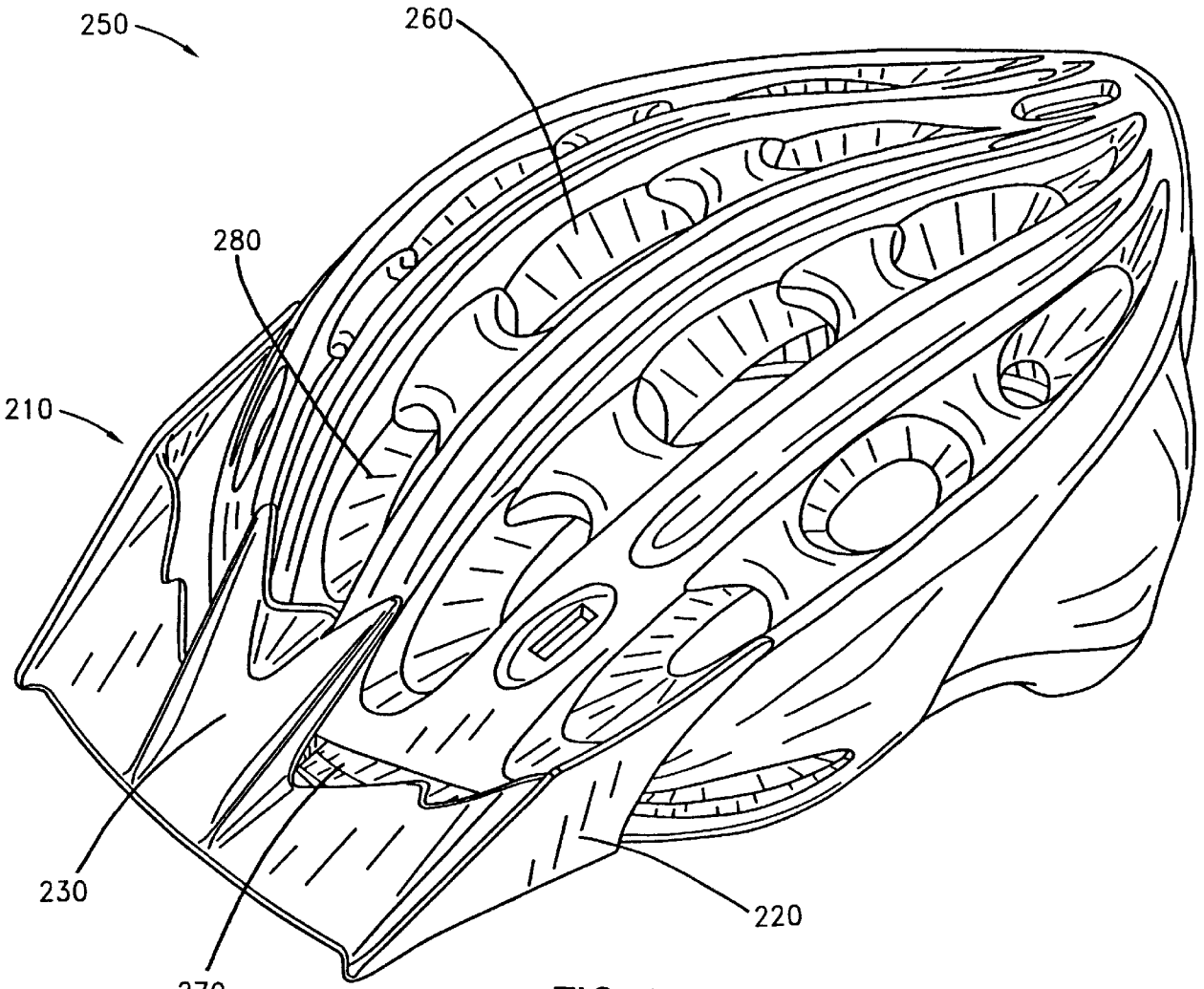
FIG. 2 is a perspective view of one embodiment of a helmet and visor.

FIG. 2 is a perspective view of one embodiment of a helmet and visor. The visor 210 is coupled to the front of the helmet 250. The visor includes side wings 220, shaped to reduce drag on the visor 210. The visor 210 is aerodynamic, and guides airflow to the vents 260 of the helmet 250. For one embodiment, the visor is a unitary element made of a single material. The visor 210 is made of a material that permits flexing. This allows the visor to fit into different designs and sizes of helmets. It further allows the visor 210 to be snapped onto the helmet 250 repeatedly, without harming the visor 210 or the helmet 250. The visor 210 may be made of thermoplastic, injection molded plastic, cast urethane, or other materials. The visor may be of an opaque, translucent, or transparent material.

The helmet 250 includes multiple vents 260. For one embodiment, the helmet 250 specifically includes a vent near the bottom edge of the helmet 250 in the front. This vent 270 is referred to as the mouthport 270, for the purposes of this application. The mouthport 270, for one embodiment, is a long wide vent. The helmet 250 further includes a vent in the center front of the helmet 250, referred to as the center front vent 280. The center front vent 280 is shaped similarly to the other vents 260. For one embodiment, the center front vent 280 is an oval shaped narrow vent.

The helmet is generally made of foam material, such as expanded polystyrene (EPS) foam. Rigidity is provided by a hard shell coupled to the foam material. For one embodiment, the areas into which the visor 210 is coupled are covered with the hard shell. In this way, the foam material of the helmet 250, which is relatively malleable, is not damaged by the repeated insertion and removal of the visor 210. The helmet 250 illustrated is merely one embodiment of a helmet 250 to which the visor 210 may be attached. Alternative helmet configurations, including fewer, more, or differently shaped vents, a different helmet shape, and other variations may be used with the visor 210.

For one embodiment, the visor 210 is coupled into the mouthport 270 and the center front vent 280 of the helmet 250. For another embodiment, the visor 210 is coupled into other vents 260 of the helmet 250. For yet another embodiment, the visor 210 is coupled to the bottom edge of the helmet 250.

Figure 3:
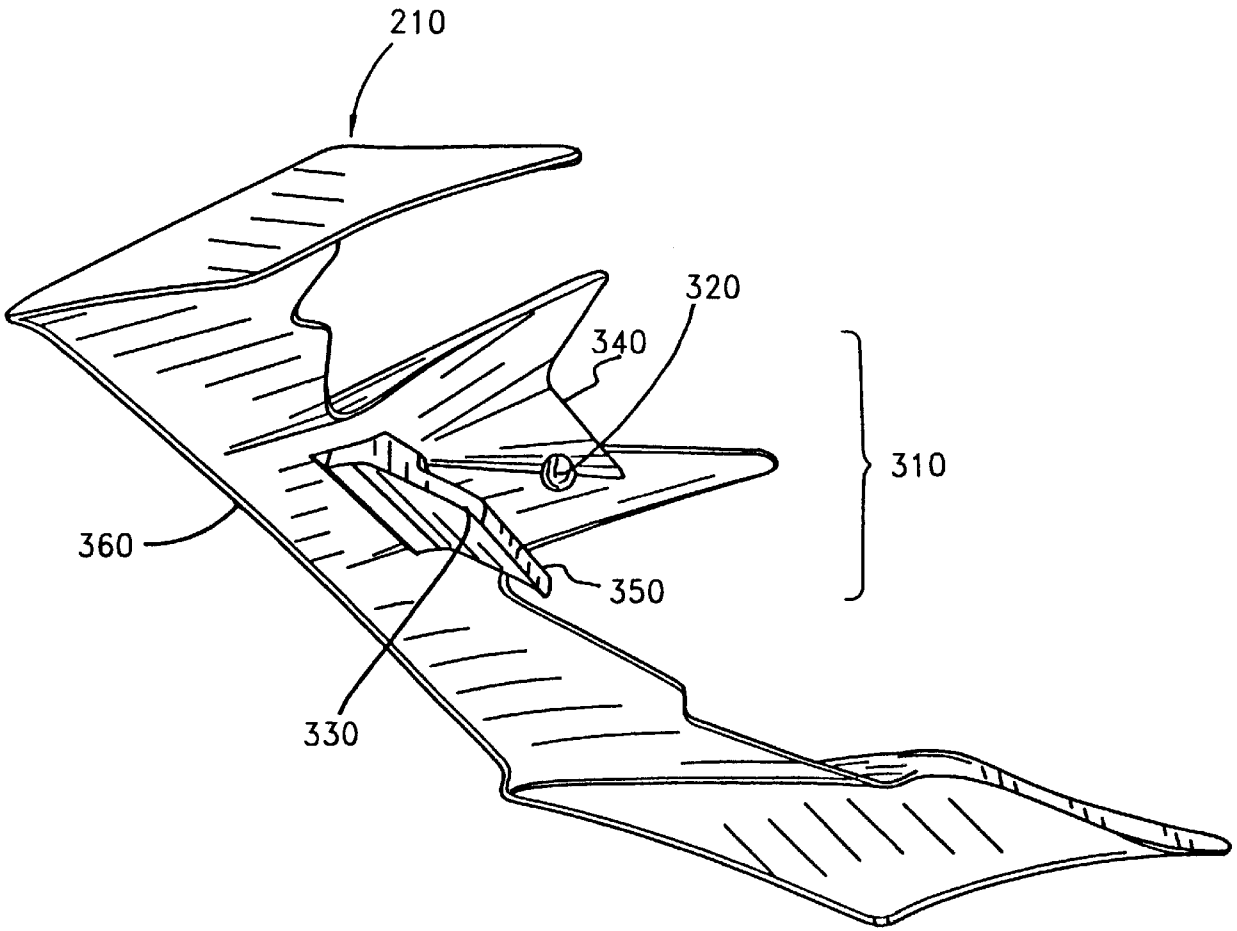
FIG. 3 is a perspective view of one embodiment of the visor.

FIG. 3 is a perspective view of one embodiment of the visor. The visor 210 includes a brim 360 to shield the wearer's eyes. The brim 360 is designed to extend beyond the front of the helmet when the visor 210 is coupled to the helmet. For one embodiment, the brim 360 has a slightly curved front. For another embodiment, the brim 360 is concave, or the brim 360 may be straight. Alternative shapes of the brim 360 may also be used.

The visor 210 includes a coupling mechanism 310. The coupling mechanism 310 includes two elements 320, 330. The upper element 320 is a snap-in button 320, designed to snap into a depression in the helmet (not shown, see FIG. 4). The button 320 is located on a top portion 340 of the visor. This top portion 340 of the visor 210 flexes to allow the insertion of the button 320 into a depression in the helmet. The lower element 330 is a cantilever clamping element 330 for securely holding the snap 330 to the helmet. For one embodiment, the lower element 330 is shaped to allow the visor 210 to be bent downward to detach the visor 210 from the helmet. For one embodiment, the front 350 of the lower element 330 is curved.

Figure 4:
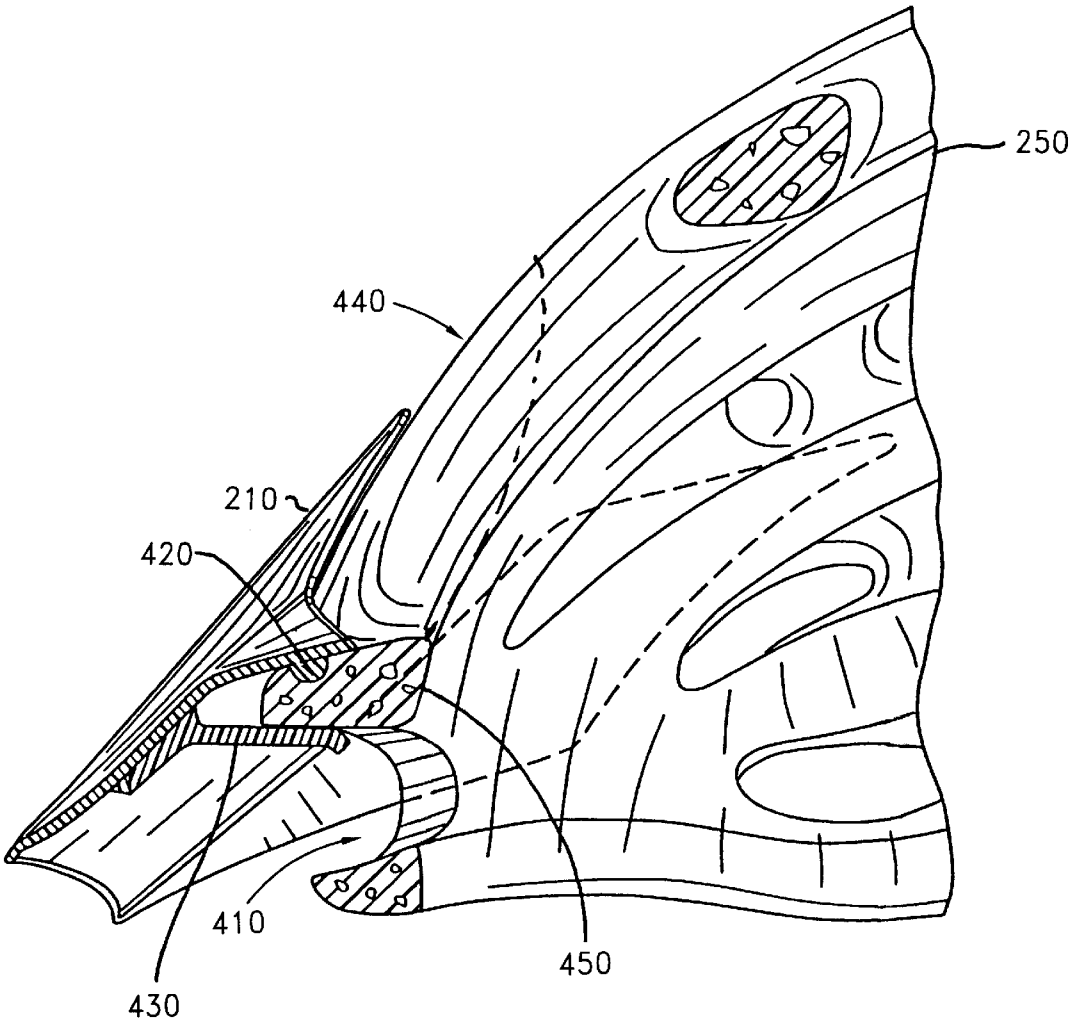
FIG. 4 is a cross-section view of the visor of FIG. 3 coupled to a helmet.

FIG. 4 is a cross-section view of the visor of FIG. 3 coupled to a helmet. The visor 210 is attached to the front of the helmet 250. Cantilever element 430 grasps the top of the mouthport 410. The snap 420 is snapped into a depression in the center front vent 440 of the helmet 250. For one embodiment, other depressions may be located within the center front vent 440, permitting the visor to be inserted in multiple positions. This allows adjustment of the projection of the visor 210.

Figure 5:
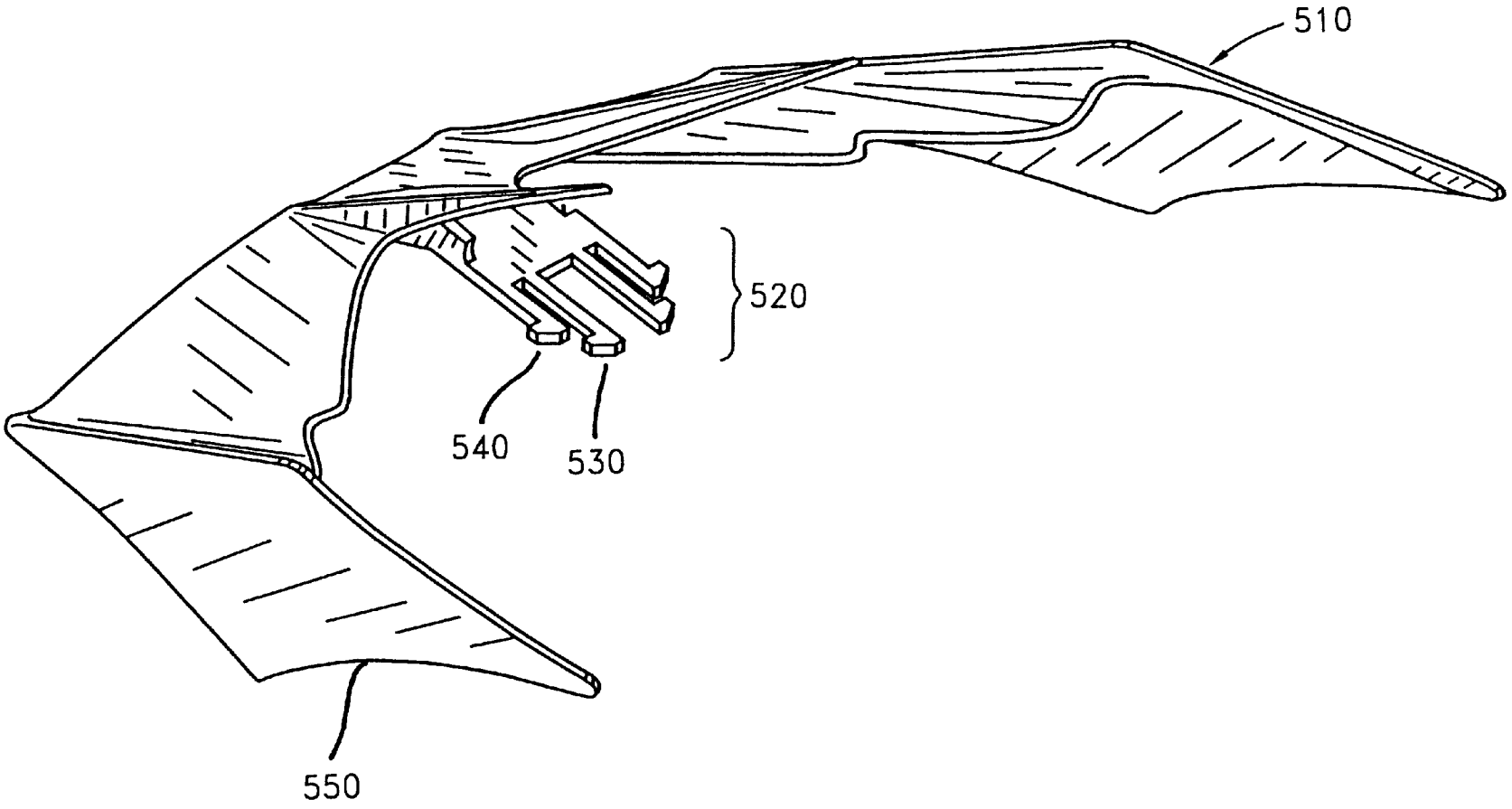
FIG. 5 is a perspective view of another embodiment of the visor.

FIG. 5 is a perspective view of another embodiment of the visor. The visor 510 includes a coupling mechanism 520. The coupling mechanism 520 is a cantilever element, coupled to the body of the visor 510 at one end. The other end of the coupling mechanism 520 includes a first snap portion 530 and a second snap portion 540.

Figure 6:
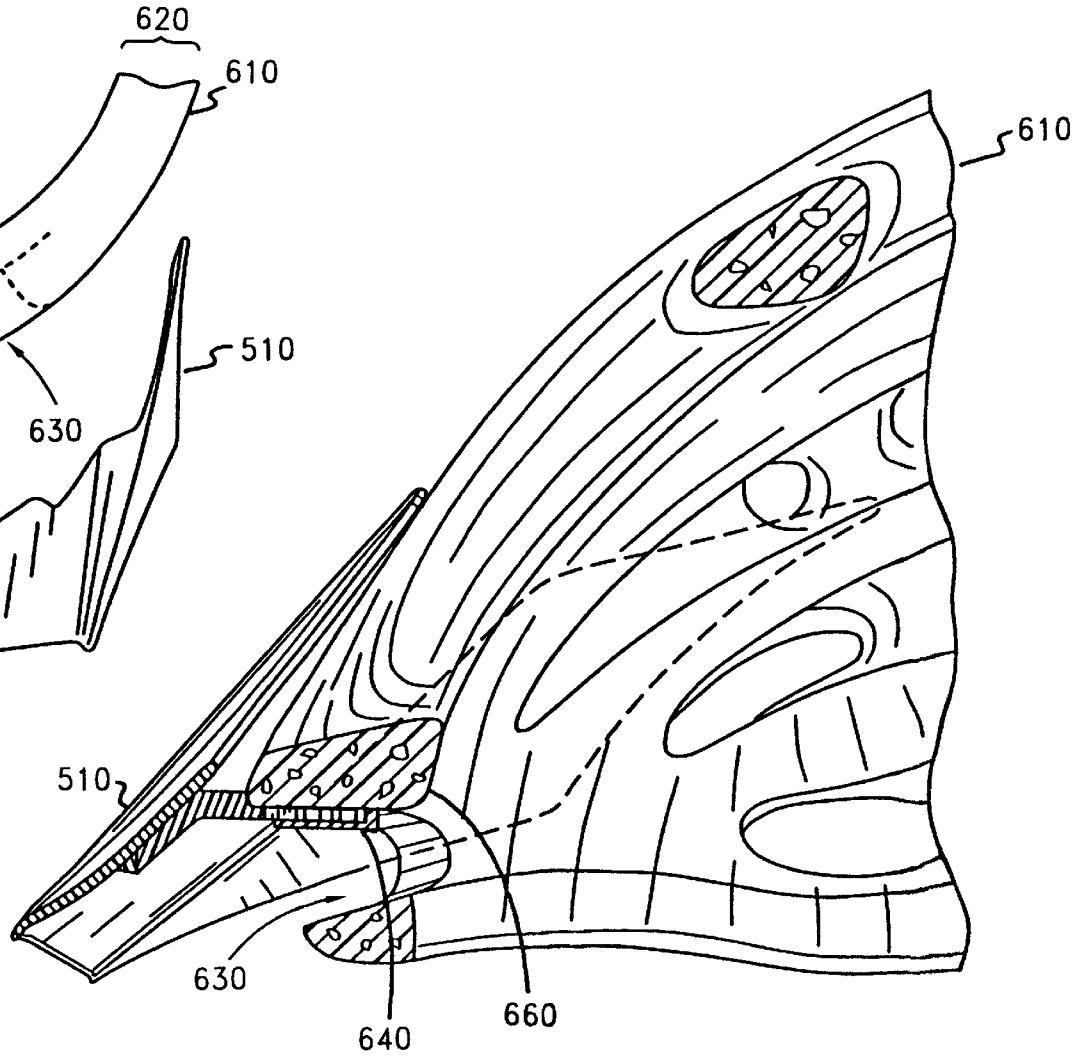
FIGS. 6 and 6A are cross-section views of the visor of FIG. 5 coupled to a helmet.
Figure 6A:
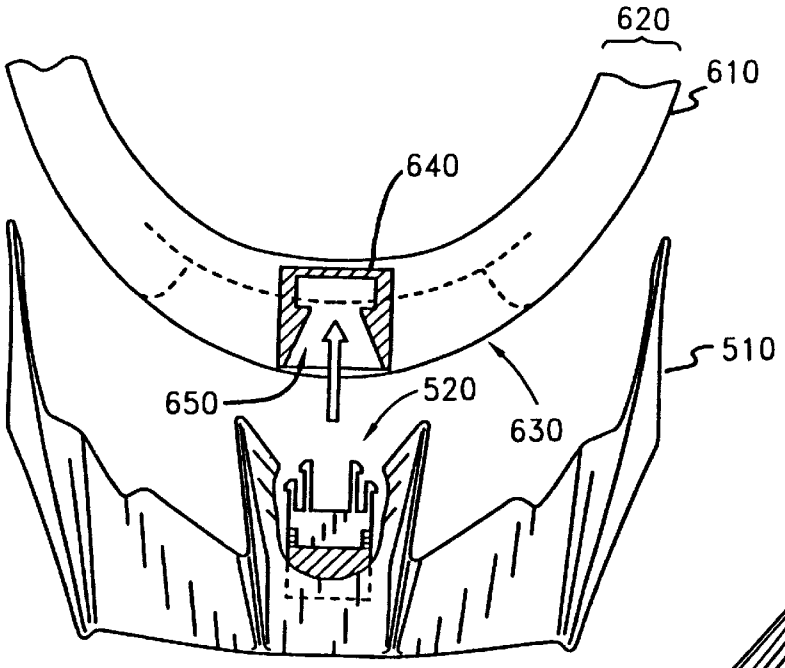

FIGS. 6 and 6A are cross-section views of the visor of FIG. 5 coupled to a helmet. FIG. 6 shows a side cross-section, while FIG. 6A shows a top cross-section of the helmet and visor. The coupling element 520 of the visor 510 is designed to be coupled into a socket 640 in the mouthport 630 of the visor 610. The socket 640 has an opening 650 to receive the coupling element 520. The snaps 530, 540 of the coupling element 520 couple into the socket 640. For one embodiment, only one set of snaps 530, 540 support the visor 510 at one time. The second set of snaps 530 are designed to couple the visor 510 to the helmet in a different position. For one embodiment, the socket 640 is molded into the mouthport 630. For another embodiment, the socket 640 is of a separate material, such as rigid plastic, that is attached to the top 660 of the mouthport 630. For one embodiment, the socket 640 is the top of the mouthport 630.

Figure 7:
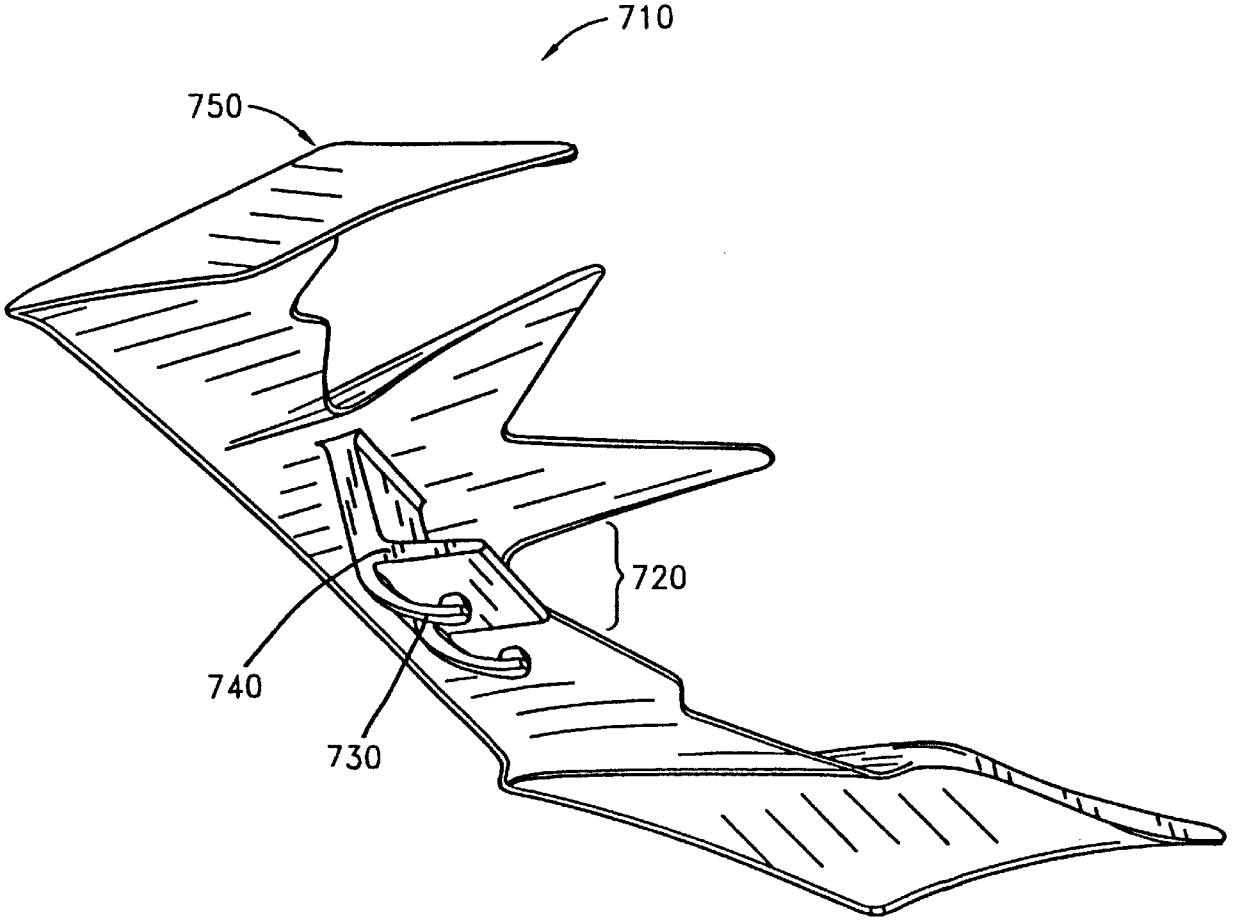
FIG. 7 is a perspective view of another embodiment of the visor.

FIG. 7 is a perspective view of another embodiment of the visor. The visor 710 includes a coupling element 720, including a cantilever element having a top portion 740 and a bottom portion 730. The visor 710 is designed to clasp the helmet between the two portions 730, 740 of the coupling element 720.

Figure 8:
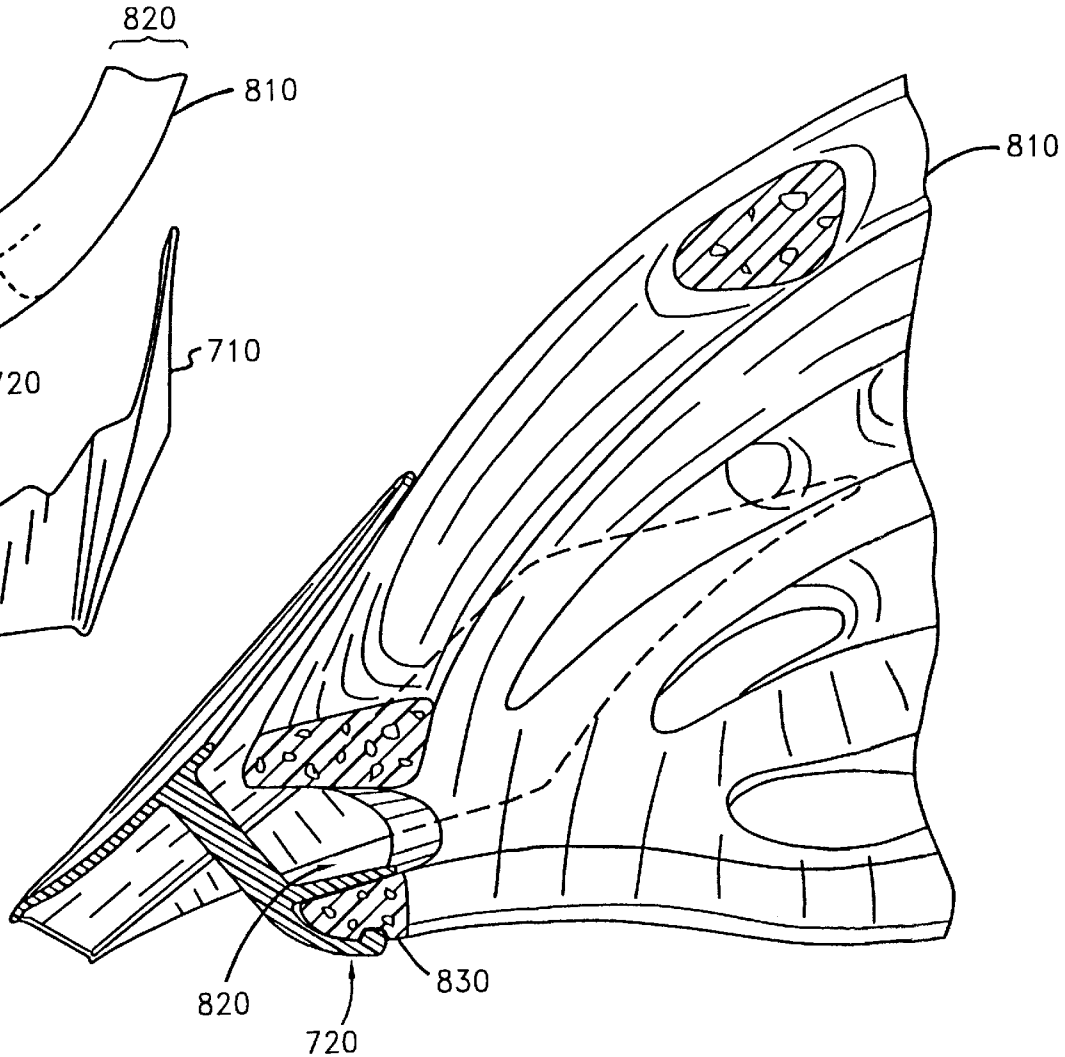
FIGS. 8 and 8A are a cross-section views of the visor of FIG. 7 coupled to a helmet.
Figure 8A:
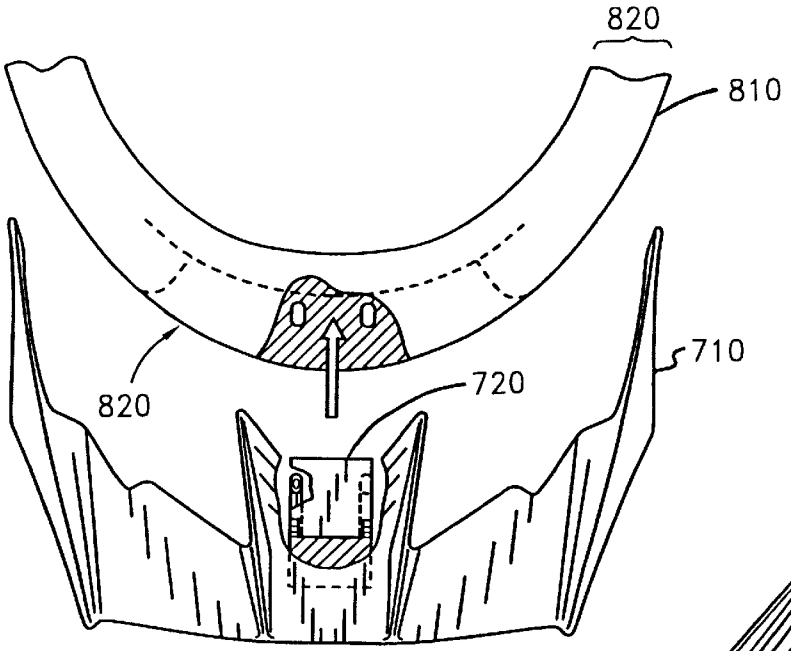

FIGS. 8 and 8A are a cross-section views of the visor of FIG. 7 coupled to a helmet. For one embodiment, the top portion 740 rests within the mouthport 820 of the helmet, while the bottom portion 730 is within a depression in the bottom edge 830 of the helmet 810. The helmet 810 may include another depression (not shown) either also in the bottom edge of the helmet, or within the mouthport, to permit the visor 710 to be coupled to the helmet in multiple positions.

Figure 9:
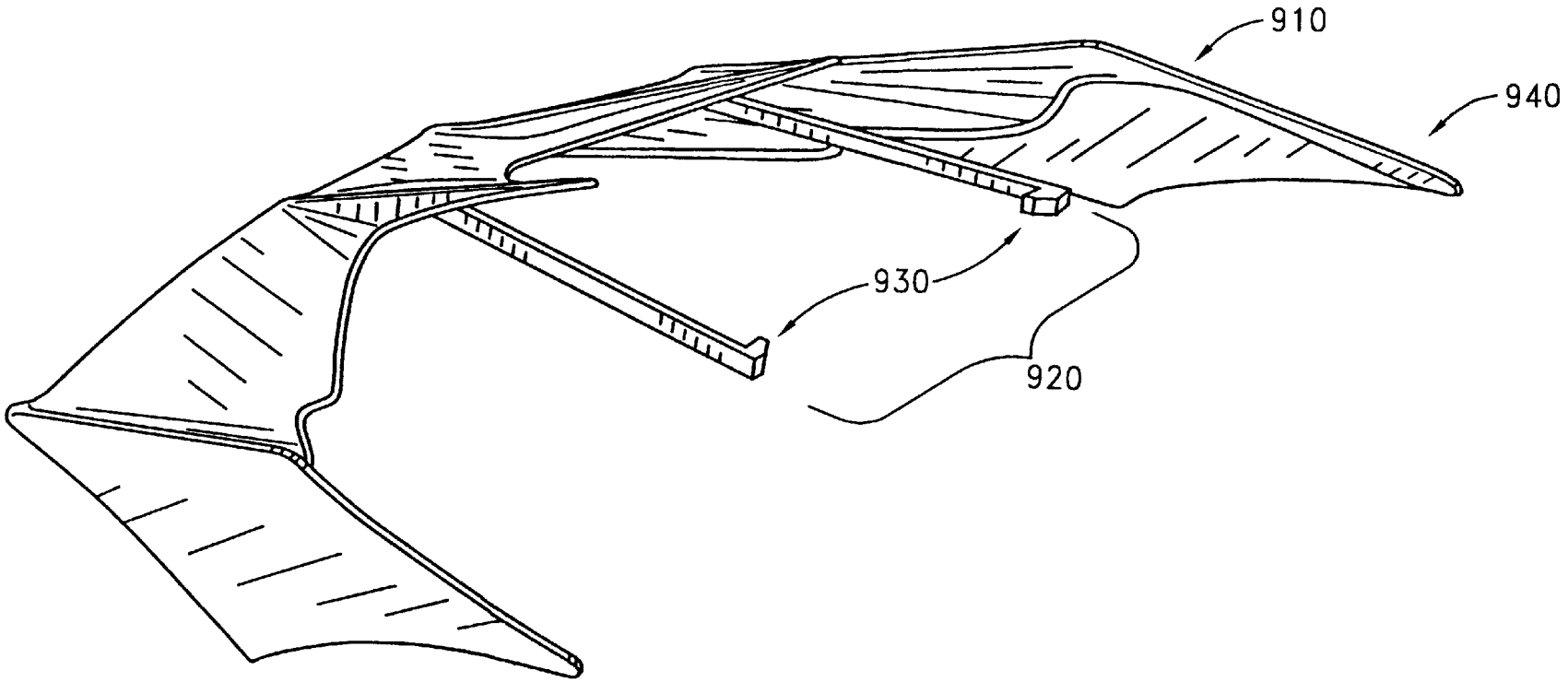
FIG. 9 is a perspective view of another embodiment of the visor.

FIG. 9 is a perspective view of another embodiment of the visor. The visor 910 includes a coupling element 920. The coupling element 920 is two long cantilevers 930, designed to grasp the helmet between them.

Figures 10, 10A:
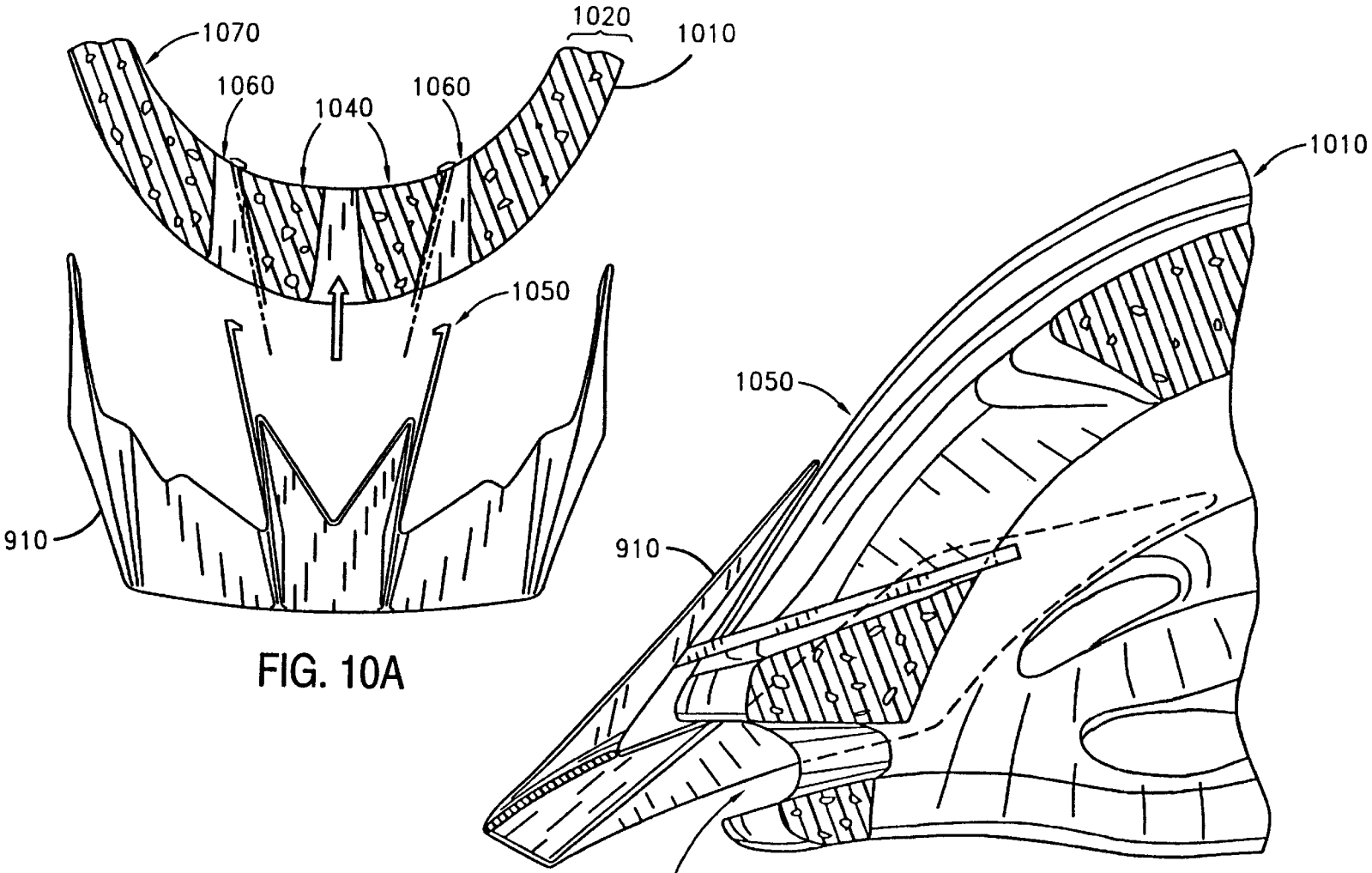
FIGS. 10 and 10A are a cross-section views of the visor of FIG. 9 coupled to a helmet.

FIGS. 10 and 10A are a cross-section views of the visor of FIG. 9 coupled to a helmet. The cantilever elements 930 slide through vents 1060 of the helmet 1010, to the inside 1070 of the helmet 1010. The edges 1050 of the cantilever elements 930 then grasp the inside 1070 of the helmet 1010. For another embodiment, the vents 1060 include one or more small depressions in their side, to receive the edge 1050 of the coupling mechanism 920. This permits the visor 910 to be coupled to the helmet 1010 at multiple positions.

Figure 11:
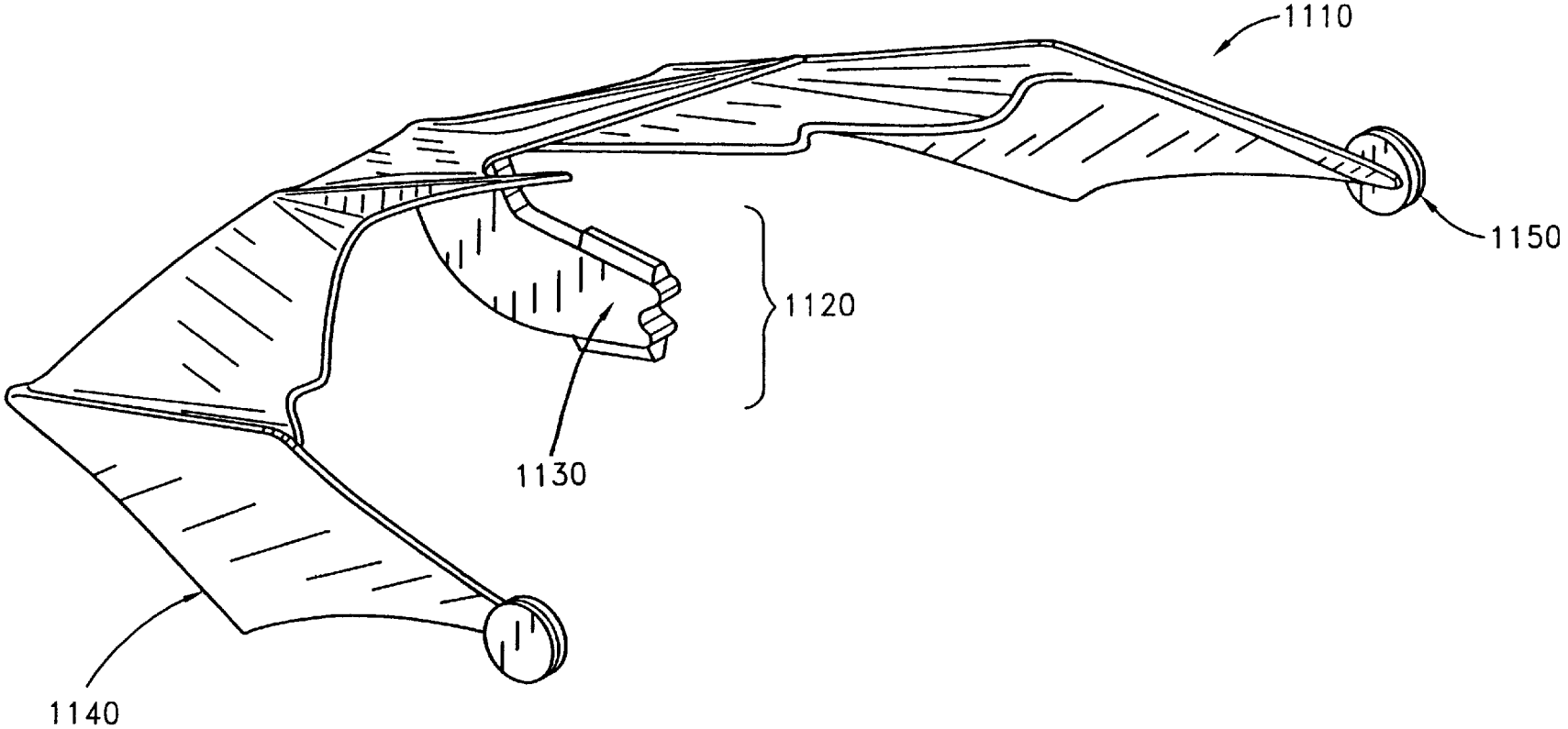
FIG. 11 is a perspective view of one embodiment of the visor.

FIG. 11 is a perspective view of one embodiment of the visor. The visor 1110 includes a coupling mechanism 1120. The coupling mechanism 1120 includes a center fin 1130 for coupling into a vent of the helmet. For one embodiment, the fin 1130 is vertical, designed to couple to the top and bottom of a vent. For another embodiment, the fin 1130 is horizontal, designed to couple to the right and left sides of the vent.

For one embodiment, the visor 1110 may also include a magnet or metal element 1150, for fastening the side portions 1140 of the visor 1110 to the helmet.

Figures 12, 12A:
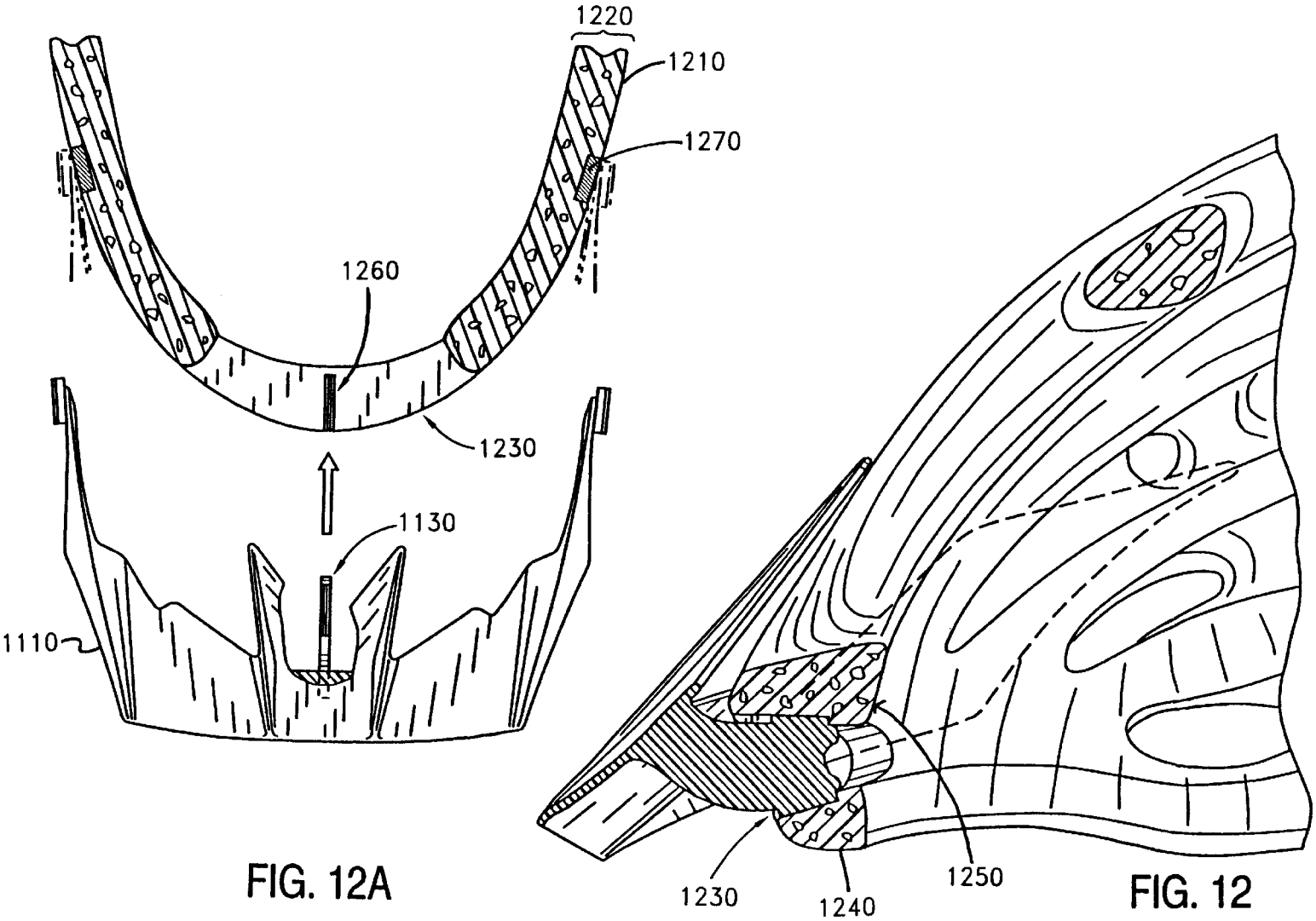
FIGS. 12 and 12A are a cross-section views of the visor of FIG. 11 coupled to a helmet.

FIGS. 12 and 12A are a cross-section views of the visor of FIG. 11 coupled to a helmet. The fin 1130 of the visor 1110 slides into the mouthport 1230 of the helmet 1210. The mouthport 1210 may include a slot 1260 shaped to receive the fin 1130. For one embodiment, the fin 1130 actually clicks into a slot in the mouthport 1230. The sides of the visor 1110 extend along the side of the helmet 1210. The magnets 1150 of the visor 1110 couple to complementary magnets 1270 on the side of the helmet. For one embodiment, either the magnet 1150 on the visor 1110 or the magnet 1270 on the helmet 1210 may be replaced by metal. For one embodiment, the magnet 1270 on the helmet 1210 is countersunk, such that the magnet 1270 does not extend from the helmet 1210. Such a side reinforcement may be included in other embodiments of the helmet and visor as well.

Figure 13:
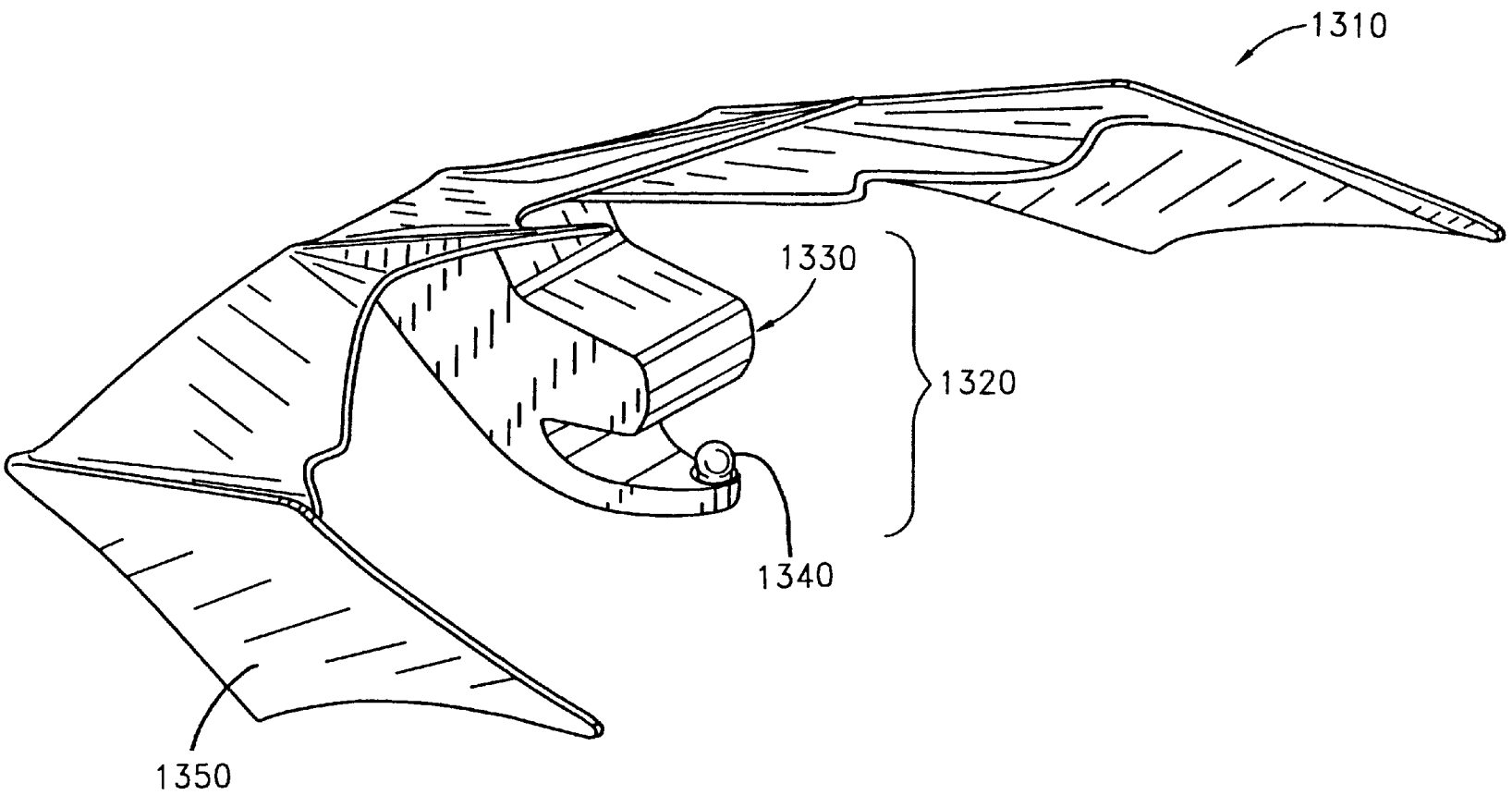
FIG. 13 is a perspective view of one embodiment of the visor.

FIG. 13 is a perspective view of yet another embodiment of the visor. The coupling mechanism 1320 includes a wedge portion 1330 for holding a ball 1340 in a depression in the helmet.

Figure 14:
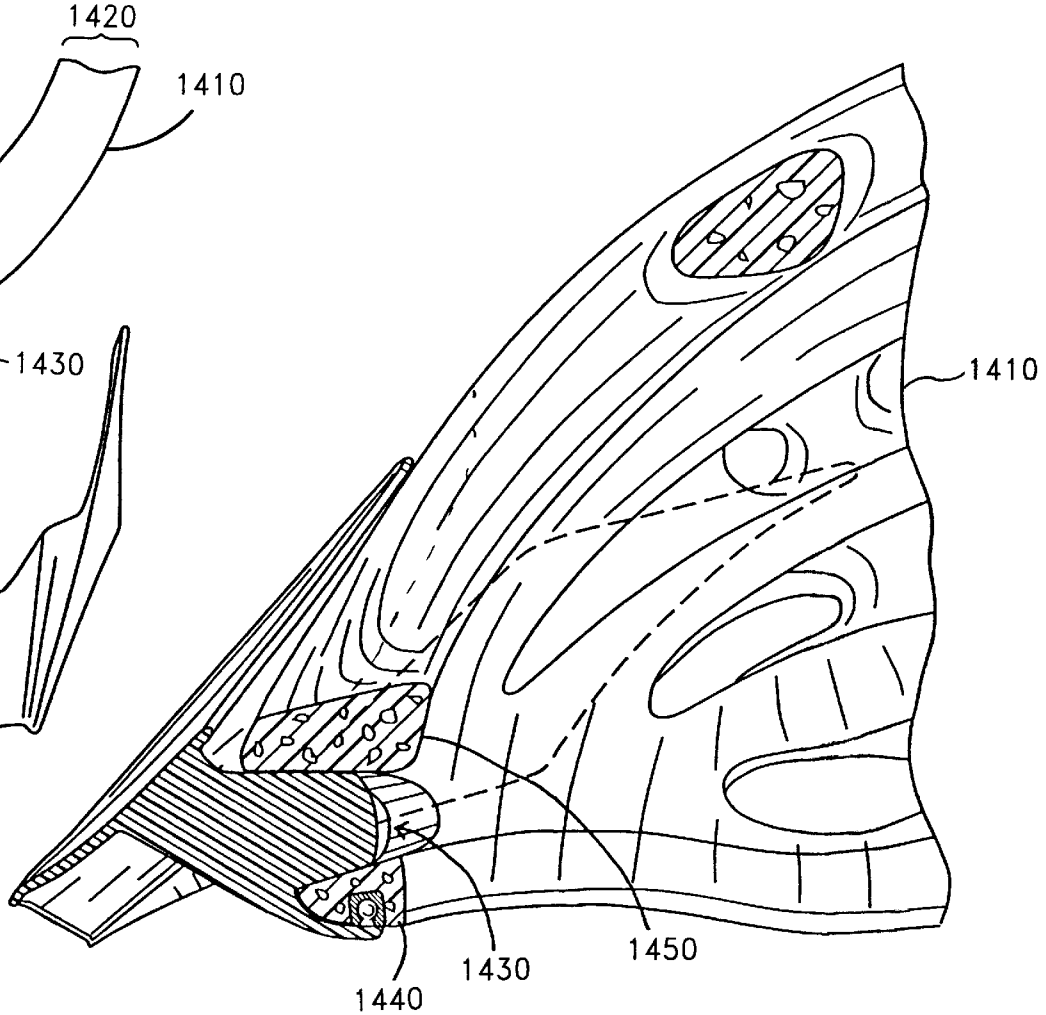
FIGS. 14 and 14A are a cross-section views of the visor of FIG. 13 coupled to a helmet.
Figure 14A:
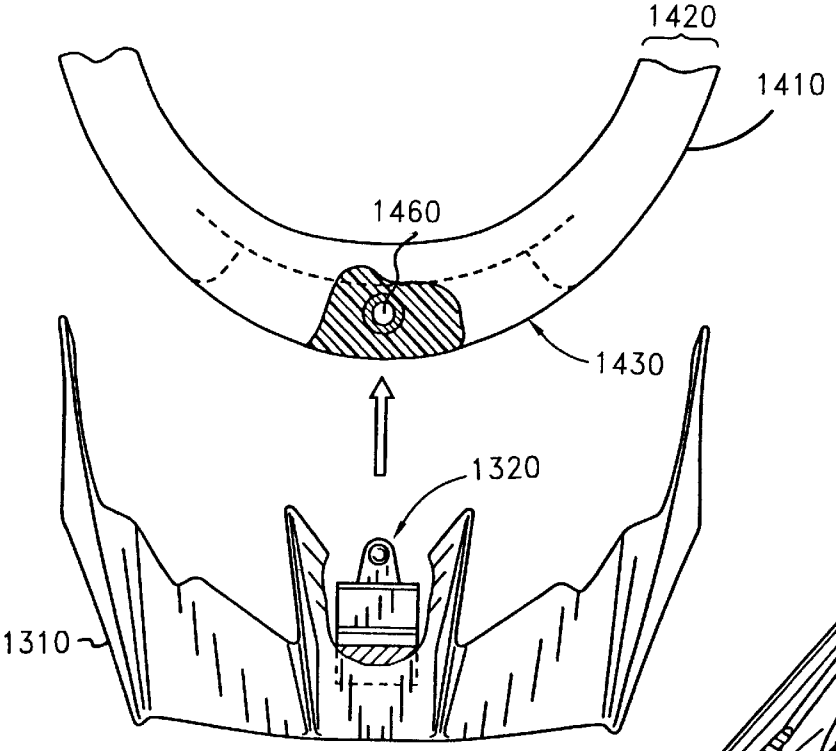

FIGS. 14 and 14A are a cross-section views of the visor of FIG. 13 coupled to a helmet. The ball 1340 of the visor 1310 snaps into a hole 1460 in the bottom of the helmet 1410. The wedge portion 1330 slips into the mouthport 1440. The wedge portion 1330 of the visor 1310 is supported by top and bottom of the mouthport 1430.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A visor for coupling to a helmet, the visor comprising:

a brim;

a coupling mechanism located at a center of the visor to removably couple the visor in a vent in the helmet;

wherein the coupling mechanism is to couple the visor into a plurality of positions on the helmet, wherein the coupling mechanism comprises a first cantilever element and a second cantilever element.

2. The visor of claim 1, wherein the second cantilever element includes a snap shaped for snapping into a depression in a center front vent of the helmet to fasten the visor to the helmet.

3. The visor of claim 2, wherein the snap is shaped to be fitted into the first depression and a second depression at a different location in the center front vent, for fastening the visor in a first and a second position, respectively.

4. A visor for coupling to a helmet, the visor comprising:

a brim;

a coupling mechanism located at a center of the visor to removably couple the visor in a vent in the helmet;

wherein the coupling mechanism is to couple the visor into a plurality of positions on the helmet further comprising a metallic portion on either side of the brim for coupling the visor to magnets embedded in the helmet.

5. A visor for coupling to a helmet, the visor comprising:

a brim;

a coupling mechanism for removably coupling the visor to the helmet, the coupling mechanism comprising a first cantilever element and a second cantilever element located about a center of the visor, at least one of the cantilever elements for fitting into a vent of the helmet;

wherein the visor is shaped to guide airflow to vents in the helmet.

6. The visor of claim 5, wherein the cantilever elements are designed to fit into a socket in the vent of the helmet.

7. The visor of claim 5, wherein the coupling mechanism couples the visor to a single point in the helmet.

8. A visor for coupling to a helmet, the visor comprising:

a brim;

a coupling mechanism located at a center of the visor to removably couple the visor in a vent in the helmet;

wherein the coupling mechanism is to couple the visor into a plurality of positions on the helmet, and wherein the coupling mechanism comprises:

a first cantilever element for inserting into a mouthport of the helmet; and a second cantilever element for inserting into a center front vent of the helmet.

9. The visor of claim 8, wherein the second cantilever element includes a snap for snapping into a depression in the center front vent of the helmet to fasten the visor to the helmet.

10. The visor of claim 9, wherein the snap is shaped to be fitted into the first depression and a second depression at a different location in the center front vent, for fastening the visor in a first and a second position, respectively.

11. A head protection system comprising:

a helmet including a plurality of vents, including a mouthport and a front center vent, the front center vent including a depression; and a visor having a coupling element for coupling to the helmet, the visor coupled to the front center of the helmet;

wherein the visor is shaped to guide airflow to the vents in the helmet.

12. A visor for coupling to a helmet, the visor comprising:

a brim;

a coupling mechanism designed to removably couple the visor directly into a socket in a vent in the helmet;

wherein the visor is shaped to guide airflow to vents in the helmet.

13. A visor for coupling to a helmet, the visor comprising:

a brim;

a coupling mechanism in a center of the visor to removably couple the visor in a vent in the helmet, the coupling mechanism including:

a first cantilever element for inserting into a mouthport of the helmet; and a second cantilever element for inserting into a center front vent of the helmet, the second cantilever element including a snap for snapping into a depression in the center front vent of the helmet to fasten the visor to the helmet;

wherein the snap is shaped to be fitted into the first depression and a second depression at a different location in the center front vent, for fastening the visor in a first and a second position, respectively, and wherein the visor is shaped to guide airflow to vents in the helmet.

* * * * *